US005154625A

United States Patent [19]

Borokowski et al.

[11] Patent Number: 5,154,625

[45] Date of Patent: Oct. 13, 1992

[54] INTEGRATED DC/RF CONNECTOR

[75] Inventors: Michael R. Borokowski, Westborough; John W. Roman, Natick, both of Mass.

[73] Assignee: Raytheon Company, Lexington, Mass.

[21] Appl. No.: 771,588

[22] Filed: Oct. 4, 1991

[51] Int. Cl.[5] ..... H01R 13/00

[52] U.S. Cl. ..... 439/161

[58] Field of Search ..... 439/67, 77, 161, 492–499

[56] References Cited

U.S. PATENT DOCUMENTS

| | | | |
|---|---|---|---|
| 29,223 | 5/1977 | Pritulsky | 339/75 |
| 3,989,336 | 11/1976 | Rizzio, Jr. et al. | 339/75 |
| 4,621,882 | 11/1986 | Krumme | 439/161 |
| 4,643,500 | 2/1987 | Krumme | 339/30 |
| 4,718,859 | 1/1988 | Gardner | 439/329 |
| 4,846,729 | 7/1989 | Hikami et al. | 439/161 |
| 4,881,908 | 11/1989 | Perry et al. | 439/161 |
| 4,904,197 | 2/1990 | Cabourne | 439/267 |
| 4,952,162 | 8/1990 | Hikami et al. | 439/161 |

OTHER PUBLICATIONS

"Electrically Actuated ZIF Connectors Use Shape Memory Alloys," J. F. Krumme of Data BAse Inc., Connection Technology, Apr. 1987.

*Primary Examiner*—Joseph H. McGlynn

*Attorney, Agent, or Firm*—Walter F. Dawson; Richard M. Sharkansky

[57] ABSTRACT

An integrated DC/RF stripline flexprint module edge connector comprises a stripline RF transmission line that operates at microwave frequencies. The connector mates and clamps DC and signal conductors in a flat flexible circuit and an RF conductor located in an RF signal stripline with a matching pattern of conductors on an edge of a module mating plug. The Rf conductor is sandwiched between two equally spaced ground planes and forms a lapjoint connection with the mating plug. The engagement of the connector to the edge of the mating plug is accomplished by a zero inserting force clamp. The clamp secures the connector comprising the DC and signal conductors and the more rigid RF signal stripline adjacent to the flexprint.

15 Claims, 2 Drawing Sheets

16
28
14
15
26
20
23
18
22
24
12
29
30
10
25
30
26

INTEGRATED DC/RF CONNECTOR

BACKGROUND OF THE INVENTION

This invention relates to electrical connectors and in particular to a combined flexible circuit and RF stripline, zero insertion force connector utilizing a shape memory alloy actuator.

Many relatively large electronic systems such as a phased array surveillance radar system having an active aperture phased array antenna requires the use of a large number of active electronic modules. There is typically an electronic transmit/receive (transceiver) module behind every radiating antenna element and there may be as many as 100,000 elements for a large aperture system. The number of connectors required for RF signals, control signals and DC power distribution to each module is formidable. The weight penalties incurred with a large distribution system and its associated interconnect hardware can compromise or even negate the advantages of using integrated circuit technology to build lightweight transceiver modules. Coaxial microwave connectors have been used for decades and their performance is well characterized. However, the conventional coaxial connector is unfortunately an unwieldy interconnect technology for trying to access multiple RF connections in an electronic module that uses integrated circuit technology. In many cases the minimum physical module size is limited by the physical size of the coaxial connectors themselves even when using miniature and sub-miniature coaxial connectors.

The microwave signal interconnections only represent one-half of the interconnect dilemma. DC power and control signals are required by all microwave transceiver modules for operation, and depending on the complexity of the module design, the number of power and signal traces will typically range between 8 and 16. The power lines may be required to handle significant amounts of pulsed or CW current, up to as much as 2 amperes peak. The remaining lines are low current logic control signal lines. Like its microwave counterpart, Multipin DC connector technology, using a shielded pin/socket mating pair is a well-proven, effective and accepted means of interconnecting transceiver modules to an array backplane. Unfortunately the multipin DC connector technology imposes the safe ultimate size limiting constraints on the transceiver design. Pin spacings of 0.100" are common; pin spacing of 0.070" are non-standard but can be implemented; pin spacings of 0.050" are custom and result in high component and assembly costs. Hence, the minimum size and weight of the module may be set by the technology used to handle the interconnect and not by the actual input/output requirements. Many electronic devices employ flexible circuitry having a plurality of electrically conductive strips disposed in a parallel array which is well known. It is also advantageous when using such flexible circuitry to employ zero insertion force (ZIF) connector technology for ease of insertion and removal, minimization of contact wear and maximization the number of electrical connections that can be made.

An example of a zero insertion force connector for flat flexible cables that permits the unobstructed entrance of the flat flexible cable into its fully seated position, and then an actuator moves to physically urge the contacts against the conductor of the flat flexible cable is disclosed in U.S. Pat. No. 3,989,336, entitled "Flexible Circuit Connector Assembly," issued to Rizzio, Jr., on Nov. 2, 1976 and assigned to Molex Incorporated of Lisle, Ill.. Another example of the zero insertion force connector for flexible flat cables of various thicknesses and having conductors on one or both sides is disclosed in U.S. Pat. No. 4,718,859, "Zero Insertion Force Connector for Flexible Flat Cable," issued to Michael J. Gardner, on Jan. 12, 1988. This ZIF connector includes an actuator that is urged in a sliding manner into contact with an initial fulcrum on a base and the actuator defines a cable channel into which the flat cable can be inserted such that the cable is guided between arms of a C-shaped contacts. The actuator is then rotated about its initial fulcrum of the base, and the cable is urged into contact with anti-overstress fulcrums on the base. Continued rotation of the actuator urges the cable into the opposed arms of the contacts to make electrical connection.

Another approach to implementing a zero insertion force multiple contact connector uses an electrically actuated shape memory alloy in combination with a C-shaped spring wherein the shape memory alloy has the ability to change from a deformed shape to an original remembered shape when triggered thermally. Such a connector is described in an article entitled "Electrically Actuated ZIF Connectors Use Shape Memory Alloys," by John F. Krumme of Beta Phase, Incorporated, Connection Technology, April 1987 which discloses the use of flexible circuitry in combination with a single element shape memory actuator without the need for cryogenic apparatus to generate cryogenic temperatures for actuation as needed in prior art applications. Also, see U.S. Pat. No. 4,643,500, "Shape Memory Actuators for Multi-Contact Electrical Connectors," issued to John F. Krumme on Feb. 17, 1987, and assigned to Beta Phase, Inc. of Menlo Park, Calif. which describes a shape memory actuator to control opening and closing of opposed pairs of contacts in cam operated multi-contact zero insertion force connectors.

An integrated DC/RF connector comprising the capability of handling high density DC and control signals and also RF signals is highly desirable for application, for example, in the previously noted phased array surveillance radar system.

SUMMARY OF THE INVENTION

Accordingly, it is therefore an object of this invention to combine in one connector conductors for carrying DC and control signals and an RF signal.

It is an object of this invention to provide an integrated DC/RF connector that has a zero insertion force connection.

It is a further object of this invention to provide a connector comprising an RF stripline to a coplanar ceramic plug using a lapjoint transition connection.

The objects are further accomplished by providing an integrated DC and RF connector comprising a flexible circuit having parallel conductors for carrying non-microwave signals, an RF signal stripline means, adjacent to the flexible circuit, having an RF conductor and parallel ground planes for providing an RF signal path, a spring means, having the flexible circuit wrapped around an upper portion of the spring means with a first end of the conductors exposed and the RF signal stripline disposed under the upper portion of the spring means in the same plane as the wrapped around exposed conductors of the flexible circuit for providing connection to a mating plug, and means disposed within a curvature of the spring means opposite an opening of the spring for providing zero insertion force engagement to the mating plug. The RF signal stripline means comprises a transitional end to enable mating of the RF conductor and the parallel ground planes to a flat mating plug having conductors and ground planes on one surface. The spring means comprises pressure pad means for clamping against an under surface of the mating plug. The means for providing zero insertion force engagement comprises a shape memory alloy.

The objects are further accomplished by providing an integrated DC and RF connector comprising a flexible circuit having parallel conductors for carrying non-microwave signals, an RF signal stripline means, adjacent to the flexible circuit, having an RF conductor and parallel ground planes for providing an RF signal path, a spring means, having the flexible circuit wrapped around an upper portion of the spring means with a first end of the conductors exposed and the RF signal stripline disposed under the upper portion of the spring means in the same plane as the wrapped around exposed conductors of the flexible circuit for providing connection to a mating plug, a shape memory alloy means disposed within a curvature of the spring means opposite an opening of the spring for providing zero insertion force engagement to the mating plug, and a heater means disposed between the spring means and the shape memory alloy means for varying the spring opening by heating the shape memory alloy means. The RF signal stripline means comprises a transitional end to enable mating of the RF conductor and the parallel ground planes to a flat mating plug having conductors and ground planes on one surface. The heater means comprises means for turning on and off said heater means.

The objects are further accomplished by providing a method of integrating DC and RF signals in a connector comprising the steps of providing a flexible circuit having parallel conductors for carrying non-microwave signals, providing an RF signal stripline means adjacent to the flexible circuit, exposing a portion of a first end of the RF signal stripline means comprising an RF conductor and parallel ground planes to enable mating of the RF conductor and parallel ground planes, positioning a spring means wherein the flexible circuit wraps around an upper portion of the spring means with a first end of the conductors exposed and the RF signal stripline extending through the spring means and being disposed under the upper portion of the spring means in the same plane as the wrapped around exposed conductors of the flexible circuit for providing connection to a mating plug, arranging a shape memory alloy means within a curvature of the spring means opposite an opening of the spring means for engagement to a mating plug, and providing a heater means between the spring means and the shape memory alloy means for varying the spring opening by heating the shape memory alloy means. The step of providing a heater means comprises the step of providing means for turning on and off the heater means. The step of positioning the spring means further comprises the step of providing a pressure pad means for clamping against an under surface of the mating plug.

BRIEF DESCRIPTION OF THE DRAWINGS

Other and further features and advantages of the invention will become apparent in connection with the accompanying drawings wherein.

DESCRIPTION OF THE PREFERRED EMBODIMENT

Figure 1:
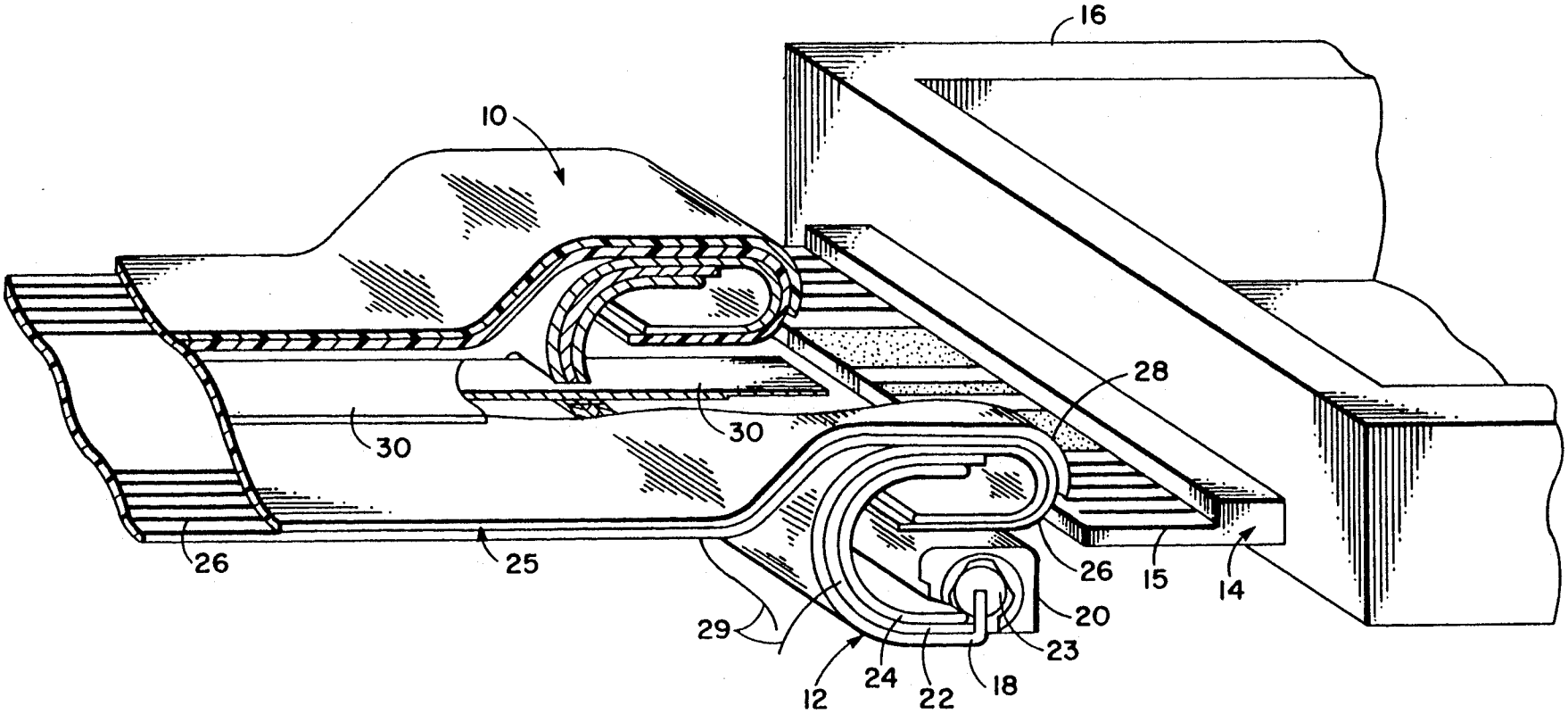
FIG. 1 is an isometric view of the integrated DC/RF connector of the present invention including a breakaway showing a section view taken through an RF signal stripline.

Referring to FIG. 1, there is illustrated an integrated DC/RF connector 10 of the present invention which provides the capability of carrying both RF and DC signals in a single connector. The DC and control signals (or non-microwave signals) are carried by conductors 26 in a flat flexible circuit 25 which is referred to as a flexprint 25 readily known to one of ordinary skill in the art. The RF signal is carried by an RF signal stripline 30 transmission line conductor which is adjacent to the flexprint 25. There may be one or more of the RF signal stripline 30 in a connector 10. The one-piece integrated DC/RF connector 10 is based on photolithography defining the DC and control signal conductors on the integrated flexible circuit 25 and then clamping the exposed conductors of the flexible circuit 25 and the RF signal stripline 30 onto mating conductors on a mating extension 15 of a ceramic plug 14.

The engagement of the open connector 10 onto a mating ceramic plug 15 results in a zero insertion force (ZIF) type of connector. The engagement is accomplished by a clamping means comprising a beryllium-copper spring 18 which in its released or "closed" state holds all DC and RF conductors 26, 30 within the flexible circuit 25 securely clamped against the ceramic plug 14 mating extension 15. A shape memory alloy (SMA) actuator 24 is used to provide a counter force against the spring 18 to place the spring 18 in its "open" position. The SMA actuator 24 provides a large force for countering the force of the spring 18 to open the connector 10. The SMA actuator 24 comprises a nickel-titanium alloy and a compact printed heater 22 element. The ability to open a strong positive clamping spring 18 in such a low mass and compact fashion provides a reliable and vibration resistant connection. The use of a multiple contact shape memory connector is well known in the art and described in the Article referenced hereinbefore in the Background section entitled "Electrically Activated ZIF Connectors Use Shape Memory Alloys" by John F. Krumme.

Figure 2:
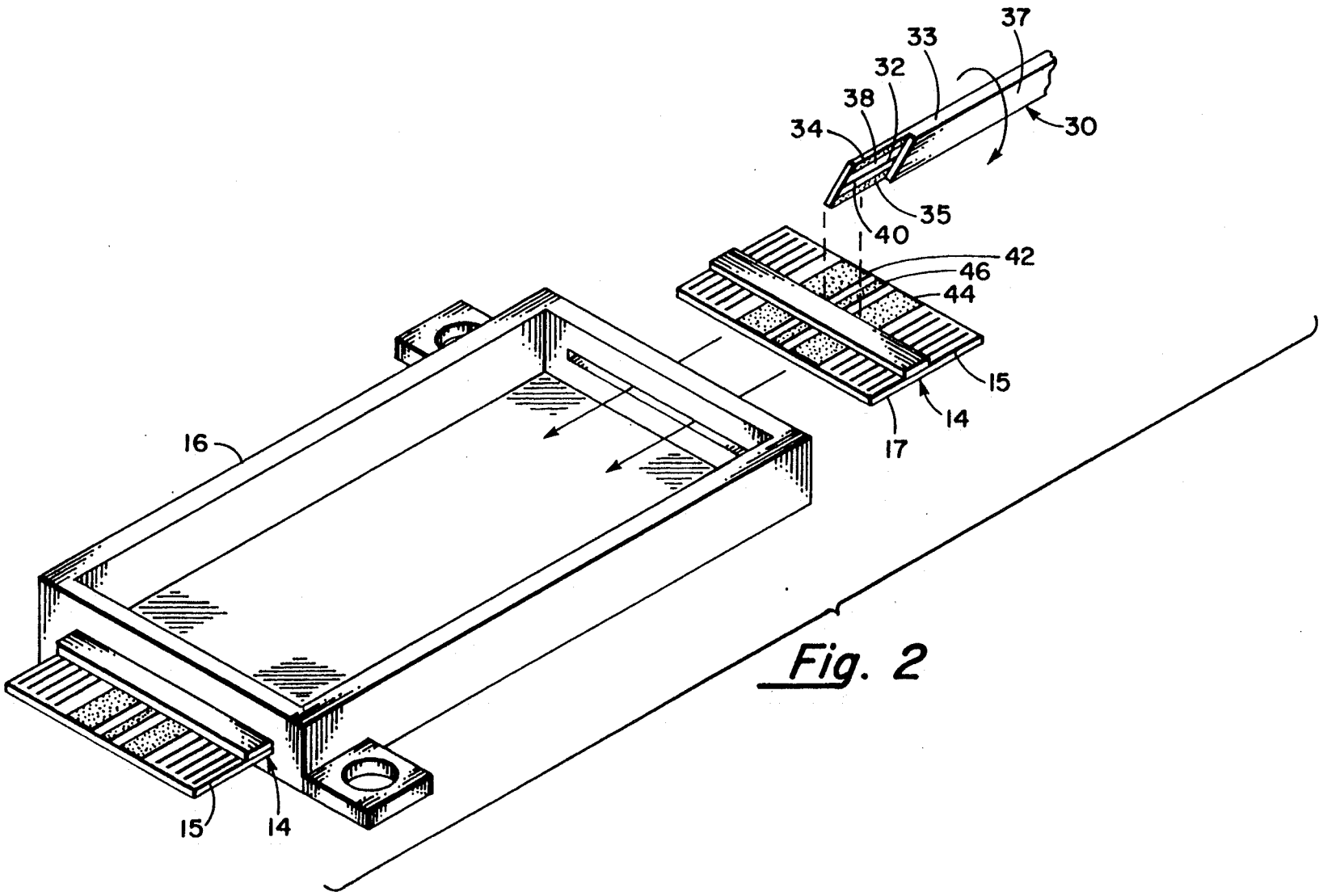
FIG. 2 is an exploded isometric view of a module for housing electronic circuitry showing ceramic plugs on two sides of the module to which an integrated DC/RF connector attaches, and also showing an expanded view of an RF signal stripline being positioned on the mating extension of the ceramic plug.

Referring now to FIG. 2, the RF signal stripline 30 is shown which is a TEM mode stripline RF transmission line attached adjacent to the flexprint 25 as shown in FIG. 1, for use at microwave frequencies. The RF signal stripline 30 is shown turned at an angle for viewing of the mating end which forms a lapjoint with the coplanar ceramic plug 14 mating extension 15. The RF signal stripline 30 comprises an RF conductor 32 dielectrically isolated and sandwiched between two equally spaced ground planes 34, 35. A transition on the end of the RF signal stripline 30 brings the ground plane contacts 34, 35 into the same plane as the center conductor 32 of the RF signal stripline 30 to accomplish a coplanar transition to the ceramic plug extension 15 comprising a dielectrically isolated RF conductor 46 and ground planes 42, 44. The sides 33, top 36 and bottom 37 surfaces of the RF signal stripline 30 are gold plated on copper and are connected to ground planes 34, 35. FIG. 2 also shows a module housing 16 having a ceramic plug 14 inserted on two sides of the module. The ceramic plug 14 comprises the mating extension 15 and an inner portion 17 for making connection to electronic circuitry within the module housing 16.

This concludes the description of the preferred embodiment. However, many modifications and alterations will be obvious to one of ordinary skill in the art without departing from the spirit and scope of the inventive concept. For example, there may be more than one RF signal stripline within an integrated DC/RF connector. Therefore, it is intended that the scope of this invention be limited only by the appended claims.

What is claimed is:

1. An integrated DC and RF connector comprising:

a flexible circuit having parallel conductors for carrying non-microwave signals;

an RF signal stripline means, adjacent to said flexible circuit, having an RF conductor and parallel ground planes for providing an RF signal path;

a spring means, having said flexible circuit wrapped around an upper portion of said spring means with a first end of said conductors exposed and said RF signal stripline disposed under said upper portion of said spring means in the same plane as said wrapped around exposed conductors of said flexible circuit for providing connection to a mating plug; and means disposed within a curvature of said spring means opposite an opening of said spring for providing zero insertion force engagement to said mating plug.

2. The connector as recited in claim 1 wherein:

said RF signal stripline means comprises a transitional end to enable mating of said RF conductor and said parallel ground planes to a flat mating plug having conductors and ground planes on one surface.

3. The connector as recited in claim 1 wherein:

said spring means comprises pressure pad means for clamping against an under surface of said mating plug.

4. The connector as recited in claim 1 wherein:

said means for providing zero insertion force engagement comprises a shape memory alloy.

5. An integrated DC and RF connector comprising:

a flexible circuit having parallel conductors for carrying non-microwave signals;

an RF signal stripline means, adjacent to said flexible circuit, having an RF conductor and parallel ground planes for providing an RF signal path;

a spring means, having said flexible circuit wrapped around an upper portion of said spring means with a first end of said conductors exposed and said RF signal stripline disposed under said upper portion of said spring means in the same plane as said wrapped around exposed conductors of said flexible circuit for providing connection to a mating plug;

a shape memory alloy means disposed within a curvature of said spring means opposite an opening of said spring for providing zero insertion force engagement to said mating plug; and a heater means disposed between said spring means and said shape memory alloy means for varying said spring opening by heating said shape memory alloy means.

6. The connector as recited in claim 5 wherein:

said RF signal stripline means comprises a transitional end to enable mating of said RF conductor and said parallel ground planes to a flat mating plug having conductors and ground planes on one surface.

7. The connector as recited in claim 5 wherein:

said heater means comprises means for turning on and off said heater means.

8. The connector as recited in claim 5 wherein:

said spring means comprises pressure pad means for clamping against an under surface of said mating plug.

9. A method of integrating DC and RF signals in a connector comprising the steps of:

providing a flexible circuit having parallel conductors for carrying non-microwave signals;

providing an RF signal stripline means adjacent to said flexible circuit;

positioning a spring means wherein said flexible circuit wraps around an upper portion of said spring means with a first end of said conductors exposed and said RF signal stripline extending through said spring means and being disposed under said upper portion of said spring means in the same plane as said wrapped around exposed conductors of said flexible circuit for providing connection to a mating plug; and arranging a means within a curvature of said spring opposite an opening of said spring to provide a zero insertion force engagement to a mating plug.

10. The method as recited in claim 9 wherein said step of providing an RF signal stripline comprises the step of exposing a transitional end of said RF signal stripline means comprising an RF conductor and parallel ground planes to enable mating of said RF conductor and parallel ground planes to a flat mating plug having conductors and ground planes on one surface.

11. The method as recited in claim 9 wherein said step of positioning said spring means further comprises the step of providing a pressure pad means for clamping against an under surface of said mating plug.

12. The method as recited in claim 9 wherein said step of providing a zero insertion force engagement comprises the step of arranging a shape memory alloy within a curvature of said spring opposite said opening of said spring.

13. A method of integrating DC and RF signals in a connector comprising the steps of:

providing a flexible circuit having parallel conductors for carrying non-microwave signals;

providing an RF signal stripline means adjacent to said flexible circuit;

exposing a portion of a first end of said RF signal stripline means comprising an RF conductor and parallel ground planes to enable mating of said RF conductor and parallel ground planes;

positioning a spring means wherein said flexible circuit wraps around an upper portion of said spring means with a first end of said conductors exposed and said RF signal stripline extending through said spring means and being disposed under said upper portion of said spring means in the same plane as said wrapped around exposed conductors of said flexible circuit for providing connection to a mating plug;

arranging a shape memory alloy means within a curvature of said spring means opposite an opening of said spring means for engagement to a mating plug; and providing a heater means between said spring means and said shape memory alloy means for varying said spring opening by heating said shape memory alloy means.

14. The method as recited in claim 13 wherein said step of providing a heater means comprises the step of providing means for turning on and off said heater means.

15. The method as recited in claim 13 wherein said step of positioning said spring means further comprises the step of providing a pressure pad means for clamping against an under surface of said mating plug.

* * * * *